US011944885B2

(12) United States Patent
Ravelli

(10) Patent No.: US 11,944,885 B2
(45) Date of Patent: Apr. 2, 2024

(54) SHUTTLECOCK AND METHOD OF MANUFACTURING A SHUTTLECOCK

(71) Applicant: Shuttlestars B.V, Amsterdam (NL)

(72) Inventor: Hanco Ravelli, Amsterdam (NL)

(73) Assignee: SHUTTLESTARS B.V., Amsterdam (NL)

( * ) Notice: Subject to any disclaimer, the term of this patent is extended or adjusted under 35 U.S.C. 154(b) by 0 days.

(21) Appl. No.: 17/042,273

(22) PCT Filed: Mar. 29, 2018

(86) PCT No.: PCT/NL2018/050199

§ 371 (c)(1),
(2) Date: Sep. 28, 2020

(87) PCT Pub. No.: WO2019/190307

PCT Pub. Date: Oct. 3, 2019

(65) Prior Publication Data

US 2021/0052962 A1 Feb. 25, 2021

(51) Int. Cl.

| | |
|---|---|
| ***A63B 67/187*** | (2016.01) |
| ***A63B 60/04*** | (2015.01) |
| ***A63B 67/193*** | (2016.01) |

(52) U.S. Cl.

CPC ..... *A63B 67/193* (2016.01); *A63B 60/04* (2015.10); *A63B 2209/02* (2013.01); *A63B 2225/01* (2013.01)

(58) Field of Classification Search

CPC ..... A63B 67/183; A63B 67/187; A63B 67/19; A63B 67/193; A63B 67/197; A63B 67/18; A63B 37/187

(Continued)

(56) References Cited

U.S. PATENT DOCUMENTS 1,620,922 A * 3/1927 Saunders ..... A63B 67/187 473/579
1,924,259 A * 8/1933 Saunders ..... A63B 67/193 473/579

(Continued)

FOREIGN PATENT DOCUMENTS

CN 105080100 A 11/2015
DE 2012696 A * 3/1970 ..... B64D 17/00

(Continued)

*Primary Examiner* — Alvin A Hunter
(74) *Attorney, Agent, or Firm* — TAROLLI, SUNDHEIM, COVELL & TUMMINO L.L.P.

(57) ABSTRACT

The present invention relates to a shuttlecock generally including a striking part and an aerodynamic part. The shuttlecock includes: a base to serve as striking element for the striking part of shuttlecock, a stems part formed by a plurality of stems to provide support to the aerodynamic part, the stems being connected or connectable with the base, and a sheeting part formed by a sheeting for forming of an aerodynamic member of the aerodynamic part attached or attachable to the stems. The stems part substantially has a shape of a pyramidal stems frustum, the base of the frustum preferably conforming to the open end of the aerodynamic part. The sheeting part, while attached to the stems, substantially has a shape of a pyramidal sheeting frustum. The edges of the pyramidal sheeting frustum are defined by the edges of the pyramidal stems frustum at an overlapping part of the sheeting part with the stems part. The aerodynamic part substantially has the shape of a pyramidal frustum defined by the pyramidal stems frustum and the pyramidal sheeting frustum.

28 Claims, 11 Drawing Sheets

(58) Field of Classification Search
USPC ..... 473/578–581
See application file for complete search history.

(56) References Cited

U.S. PATENT DOCUMENTS

| | | | | | |
|---|---|---|---|---|---|
| 2,016,252 | A * | 10/1935 | Mcnamara | A63B 67/183 | 473/580 |
| 2,025,325 | A * | 12/1935 | Bauer | A63B 67/19 | 473/580 |
| 2,059,930 | A * | 11/1936 | Booth | A63B 67/19 | 473/580 |
| 2,088,573 | A * | 8/1937 | Bramall | A63B 67/19 | 473/580 |
| 2,212,079 | A * | 8/1940 | Saunders | A63B 67/193 | 473/579 |
| 2,359,726 | A * | 10/1944 | Booty | A63B 67/18 | 473/580 |
| 2,626,805 | A * | 1/1953 | Carlton | A63B 67/187 | 473/579 |
| 2,626,807 | A * | 1/1953 | Carlton | A63B 67/18 | 473/579 |
| 2,761,685 | A * | 9/1956 | Lashley | A63B 67/187 | 473/579 |
| 3,331,573 | A * | 7/1967 | Winker | B64D 17/00 | 244/145 |
| 3,359,002 | A * | 12/1967 | Wolf | A63B 67/193 | 473/579 |
| 3,368,815 | A * | 2/1968 | Alabastro | A63B 67/183 | 473/575 |
| 3,752,479 | A * | 8/1973 | Chung | A63B 67/18 | 473/580 |
| 3,891,215 | A * | 6/1975 | Maconachie | A63B 67/193 | 473/579 |
| 4,101,128 | A * | 7/1978 | Yellen | A63B 67/183 | 473/459 |
| 4,657,262 | A * | 4/1987 | Buckland | A63B 67/19 | 473/580 |
| 4,776,596 | A * | 10/1988 | Nojima | A63B 43/00 | 473/165 |
| 5,421,587 | A * | 6/1995 | Mao-Huang | A63B 67/187 | 473/579 |
| 5,924,943 | A * | 7/1999 | Sklar | A63B 67/187 | 473/579 |
| 7,258,635 | B2 * | 8/2007 | Brandes | A63B 67/193 | 473/579 |
| 7,951,018 | B2 * | 5/2011 | Caya | A63B 57/15 | 473/387 |
| 9,061,193 | B2 * | 6/2015 | Dai | A63B 67/18 | |
| 9,132,328 | B1 * | 9/2015 | Daole | A63B 67/18 | |
| 9,272,201 | B2 * | 3/2016 | Ormsby | A63F 3/00041 | |
| 9,440,130 | B2 * | 9/2016 | Dai | A63B 67/187 | |
| 2006/0199683 | A1 * | 9/2006 | Brandes | A63B 67/187 | 473/579 |

FOREIGN PATENT DOCUMENTS

| | | | | | |
|---|---|---|---|---|---|
| DE | 102005039121 | A1 * | 3/2007 | A63B 67/187 | |
| EP | 0045825 | A1 * | 8/1980 | | |
| FR | 2596662 | A2 * | 10/1987 | A63B 67/187 | |
| FR | 2890870 | A1 * | 3/2007 | A63B 67/187 | |
| GB | 949110 | | 2/1964 | | |
| GB | 1083161 19 | | 9/1967 | | |
| GB | 2096473 | A * | 10/1982 | A63B 67/18 | |
| GB | 2263412 | A * | 7/1993 | A63B 67/187 | |
| GB | 2453444 | A * | 4/2009 | A63B 57/15 | |
| GB | 2453444 | A | 8/2009 | | |
| JP | 2000042157 | A * | 2/2000 | | |
| JP | 2001252383 | A * | 9/2001 | | |
| JP | 2003284800 | A * | 10/2003 | | |
| JP | 2012011175 | A * | 1/2012 | | |
| JP | 2017038634 | A * | 2/2017 | A63B 67/19 | |
| WO | 2008038040 | A1 | 3/2008 | | |

* cited by examiner

SHUTTLECOCK AND METHOD OF MANUFACTURING A SHUTTLECOCK

CROSS-REFERENCE TO RELATED APPLICATION

This application is the United States national phase of International Application No. PCT/NL2018/050199 filed Mar. 29, 2018, the disclosure of which is hereby incorporated by reference in its entirety.

BACKGROUND OF THE INVENTION

Field of the Invention

The present invention relates to a badminton shuttlecock generally comprising a striking part and an aerodynamic part.

Furthermore, the present invention relates to a method of manufacturing such a badminton shuttlecock according to the present invention.

Description of the Invention

A badminton shuttlecock is a projectile that is used in the sport of badminton having the shape of an open cone with a high aerodynamic drag. The cone is traditionally formed of a number of overlapping goose feathers embedded into a rounded cork base which is covered with thin leather. The shape of a badminton shuttlecock makes it extremely stable aerodynamically and regardless of its initial orientation, it will turn to fly base first and remain in the base first orientation during flight. The feathers of a traditional badminton shuttlecock are prone to damage because they are brittle and fragile. As a result, shuttlecocks may need to be replaced several times during a single game.

In contrast to a traditional badminton shuttlecock produced with goose feathers, plastic badminton shuttlecocks have been produced, the plastic skirt shuttlecocks having an advantage of durability but also a disadvantage of having undesired flight characteristics.

SUMMARY OF THE INVENTION

In order to improve upon the prior art, the present invention provides a badminton shuttlecock (100) generally comprising a striking part and an aerodynamic part, the badminton shuttlecock comprising:

- a base (110) to serve as striking element for the striking part of the shuttlecock,
- a stems part formed by a plurality of stems (130) to provide support to the aerodynamic part, the stems being connected or connectable with the base,
- a sheeting part formed by a sheeting (140) for forming of an aerodynamic member of the aerodynamic part attached or attachable to the stems, in which:
  - the stems part substantially has a shape of a pyramidal stems frustum, the base of the frustum preferably conforming to the open end of the aerodynamic part,
  - the sheeting part, while attached to the stems, substantially has a shape of a pyramidal sheeting frustum,
  - the edges of the pyramidal sheeting frustum are defined by the edges of the pyramidal stems frustum at an overlapping part of the sheeting part with the stems part, such that:

- the aerodynamic part substantially has the shape of a pyramidal frustum defined by the pyramidal stems frustum and the pyramidal sheeting frustum.

A badminton shuttlecock according to the present invention provides durability in combination with desired flight characteristics. Durability is attained by providing the stems to define the pyramidal frustum shape. Because the pyramidal frustum shape is effected, the number of stems is substantially lower than the number of feathers on which the original shuttlecock is based. Relative to the feather shuttlecocks of the prior art, the life expectancy of a badminton shuttlecock according to the present invention is significantly higher. Where a feather badminton shuttlecock is expected to be replaced within the duration of a game, the newly provided shuttlecock should only require replacement after a plurality of games. The prior art plastic badminton shuttlecocks are designed to imitate the visual effect the feather badminton shuttlecocks provided, or to provide a shape even more closely resembling a cone. The effect of such a plastic shuttlecock is that the structure of the cone is rather flexible.

A disadvantage thereof is that at high speeds, the shape is not stable. Because of the production method of the prior art plastic cone shaped shuttlecock, spin inducing shapes were incorporated in the shape of the cone by providing an asymmetrical wave pattern in the surface of the cone. This basically imitated the overlapping arrangement of the feather cones. These shapes and effects have been left behind by the present invention in order to provide the design according to the present invention in which a rather smaller amount of structural stems are provided.

According to a first preferred embodiment, the present invention provides that in the shuttlecock the stems each form a self-supporting edge part of the pyramidal stems frustum, preferably wherein the stems have a bigger thickness near the base than near the other end. The advantage of the stems being self-supporting is that the shape can be provided and that the rigidity of the stems provides the capability to retain shape during game play, such as when the shuttlecock is being hit and when the shuttlecock is in flight. The relatively small number of stems defining the pyramidal shape allows for both highly rigid stems that are capable to withstand forces during game play and preferably direct hits by a racquet. The high rigidity of the stems provides for a desired form stability during game play, such as preferably low deformation during hits and at high speeds. Thus, the favorable flight characteristics are achieved in combination with the favorable durability characteristics. The thinner thickness near the end away from the base provides a weight saving effect at locations where less strength is required. Also a greater strength is achieved near the base, where racquet hits are more common and harder.

According to a further preferred embodiment, in the shuttlecock the pyramidal frustum is a polygonal pyramidal frustum with clearly distinguishable planes between the edges, the planes being suitable for comprising a graphical representation. A positive result of the design with a limited number of stems relative to the number of feathers in a traditional shuttlecock, is that clearly recognizable planes are defined between the stems. This provides the opportunity of providing a clearly recognizable print on such a plane or for example two adjacent planes. Furthermore, this provides an advantage that the shuttlecock is highly visible during gameplay based on a contrast between the shuttlecock and the surroundings. This provides clear advantages for having recognizable logos, such as of a club, or a sports organization, present on the shuttlecock.

Preferably, the pyramidal frustum is based on a polygon of less than ten sides, being a triangular pyramid, a quadrangular pyramid, a pentagonal pyramid, a hexagonal pyramid, a septagonal pyramid or octagonal pyramid, a nonagonal pyramid, such sides providing clearly distinguishable planes between the edges of the pyramidal frustum and most effectively providing the structural advantages as indicated elsewhere in the description. Further preferably, the pyramidal sheeting frustum has an imperfect character such as forming an imperfect pyramidal sheeting frustum or a loosely pyramidal sheeting frustum. Preferably, the imperfection indicates that the sheeting material may be affixed such that it is either very tight, thereby providing a tension on the stems keeping the stems somewhat bend inward, or sheeting material may be affixed such that it is rather loose, thereby allowing the material to move somewhat widely attached.

According to a further preferred embodiment, the sheeting comprises textile or plastic, such as a plastic film, further preferably wherein the plastic film is a plastic film reinforced with fibers, the material preferably being printable. Such materials provide both the desired durability and the flight characteristics. Fastening of such materials to the stems is achieved by for example providing a channel material at the location of an arrangement of the stem, gluing the material to the stem and/or melting the material to the stem.

Further preferably, the shuttlecock comprises a print on one or more of the planes of the pyramidal shape. This provides recognizability of the shuttlecock within an environment of use and during play.

Further preferably, the sheeting part (140) extends to at least the distal end of the stems (130). There are several advantages conceived by having the sheet material extending to or beyond the respective end of the stems including that the stem ends are protected and that users are protected from the stem ends.

According to a preferred embodiment, the sheeting part (140) is provided with one or more layers. In a single layer embodiment, the sheeting part is preferably adhered to the stems, such as glued or melted. In a multilayer embodiment, channels to arrange the stems in, preferably arranged between the layers of the sheeting part. Preferably, when the sheeting material is melted to fix it to the stems, it will cover only part of the cross-sectional circumference, such as in a range of 90°-330°, such as 170-270°, more preferably 190-270°.

Further preferably, said stems (130) comprise a fiber-reinforced composite, preferably the fiber is chosen from at least one of i) carbon-fiber, ii) glass-fiber in order to obtain a desirable level of durability and or stiffness. Other materials considered for the stems comprise Polyether ether ketone (PEEK) materials. Stems are both considered as massive stems or hollow tubes, preferably with a filler material.

According to a further preferred embodiment, the base (110) comprises a substantially conical recess (512) whereby the stems (130) are positioned between the conical surface of the conical recess (512) and an insert (550), said insert (550) comprising recesses (551) for receiving end parts of the plurality of stems (130). Such arrangement provides advantages in manufacturing and arrangement of the parts. Said insert is preferably fastened in the base by means of a snap fitting. The insert is considered as a carbon filled plastic part.

In order to provide spin to a shuttlecock during flight, the shuttlecock further preferably comprises, preferably aerodynamic, spin inducing means for providing a substantially axial rotation or spin to the shuttlecock. Such spin contributes to flight characteristics, such as maintaining a desired trajectory.

Preferably, the spin inducing means are embodied by at least one opening in the sheeting part, preferably by one opening in the sheeting part per plane of the pyramidal sheeting frustum. Further preferably, the spin inducing means are located between a center line and an edge of a plane of a pyramidal sheeting frustum. Further preferably, the spin inducing means comprise at the edge of the wide end thereof a plurality of cut-outs (946). Therefore, such embodiment assists in the flight characteristics fulfilling the desires of players.

A further aspect of the present invention provides a method of manufacturing a shuttlecock (100), said shuttlecock (100) having

- a base (110) to serve as striking element for the striking part of the shuttlecock,
- a stems part formed by a plurality of stems (130) to provide support to an aerodynamic part, the stems being connected or connectable with the base,
- a sheeting part formed by a sheeting (140) for forming of an aerodynamic member of the aerodynamic part attached or attachable to the stems, the method comprising steps for:
- arranging and/or fixating the stems part relative to the base such that the stems part substantially has a shape in the form of a pyramidal stems frustum, the base of the frustum preferably being formed by the open end of the aerodynamic part,
- arranging and/or fixating the sheeting part at the stems part such that the sheeting part obtains substantially a shape in the form of a pyramidal sheeting frustum, and such that,
- the edges of the pyramidal sheeting frustum are defined by the edges of the pyramidal stems frustum at an overlapping part of the sheeting part with the stems part, such that:
- the aerodynamic part substantially has the shape of a pyramidal frustum, defined by the pyramidal stems frustum and the pyramidal sheeting frustum.

With this aspect according to the present invention, advantages as described in conjunction with the other aspect are achieved.

Preferably, the method comprises the steps of:

- providing the sheeting part (140) with a print, preferably a print per plane of the pyramidal frustum.

Further preferably, the method is performed while using stems comprising fiber, comprising at least one of i) carbon-fiber, and ii) glass-fiber.

According to a preferred embodiment, the method comprises steps of:

- providing the base (110) with a plurality of holes (211), and
- inserting stems (130) into said holes (211) of said base (110).

According to a further preferred embodiment, the method comprises steps of:

- providing a base (110) comprising a conical recess (512) with the stems (130), the stems (130) being positioned between the conical surface of the recess (512) and an insert (550), said insert (550) comprising recesses (551) for receiving proximal parts of the plurality of stems (130).

According to a further preferred embodiment, the method comprises steps of forming the sheeting part (140) by:

providing an end part of the plurality of stems (130) with a sleeve of plastic, and subjecting the sleeve of plastic to heat to shrink-wrap said distal part of the plurality of stems (130).

Further preferably, the cross-section respectively slicing surface of each stem will be 0.5 to 4.0 mm or 0.2 to 12.6 $mm^2$. A cross-section between 1.5 and 3.0 mm or a slicing surface between 1.8 to 7.1 mm2 of each stem is preferred. They may for example be quadrangular, flat, round or triangular shaped. The stems may be straight or non-straight such as curved or comprising one or more bends. A stem of the plurality of stems will typically have a length (shortest distance between its both ends) between 40 and 100 mm, in particular between 55 and 75 mm. Optionally, the sheeting part is connected to the stems by being hooked with threads to the stems.

Further preferable features of the sheeting is that the sheeting comprises a film, and in particular a rib-less film, the rigidity of the pyramidal sheeting part being provided by the stems. The term "film" includes plastic, cloth and reinforced paper or a combination thereof.

Typically, the sheeting part, surrounds the plurality of stems. The sleeve of a shuttlecock preferably has a weight per $m^2$ of 30-175 $g/m^2$, preferably 35-125 $g/m^2$ and more preferably 40-70 $g/m^2$.

The proximal ends of the stems may be received in individual openings or holes in the base. Thus the individual stems are in a fixed position relative to each other. Fastening therein is provided by means of glue, friction fit, or a combination thereof.

The base comprises preferably a body of rigid foam, such as ethylvinylacetate (EVA), polyurethane (PU) foam or polystyrene (PS) foam. Typical densities are in the range of 200-300 grams/liter. The print preferably comprises ink, which may be of any kind, such as sublimation ink.

The film preferably extends along the circumference of the shuttlecock, connecting the stems. Advantageously, the use of one or more threaded bands known to connect and hold the stems of feathers in position in the prior art are omitted according to the present invention, saving work and cost. It also saves weight, the weight of which is instead used for a better balance and strengthening the construction of other parts of the shuttlecock e.g. sturdier and thus heavier stems. According to a favorable embodiment, the plastic film is a plastic film reinforced with fibers.

The plastic of the plastic film is preferably nylon. Such reinforced plastic is commercially available. This provides for improved longevity of the shuttlecock and/or a reduced weight. The fibers are preferably super fibers. Super fibers have a tensile strength greater than 4 g/de-nier, which is more than steel. An example of a super fiber is Dyneema®.

According to a further preferred embodiment, the distal end portions of the stems are slightly bent towards the center line of the shuttlecock. This further reduces the deformation of the sheeting part section during play, in particular if the sheeting part section is hit by a player. Also, this allows for the stems to be held in place in holes in the base for some embodiments of the shuttlecock according to the invention.

According to a further preferred embodiment, the sheeting part comprises multiple layers comprising plastic, imprints, dimples, texture etc. This way the surface of the sheeting part of shuttlecock can be adapted for favorable characteristics or as a means for conveying a message. An extra layer preferably provides for extra durability by means of strengthening the sheeting part and/or the stems against wear and tear. It also can provide for extra cushioning at specific locations on the sheeting part to protect the stems against impact, for example as result of impact from the racket during play. Layers with specific shapes are considered to be applied to the sheeting part to provide for extra spin or for other aerodynamic characteristics like more or less drag. By adding layers in shapes and colors including white and black, the sheeting part can be used to convey a message which is not possible with current shuttlecocks.

According to a favorable embodiment, said stems comprise a fiber-reinforced compound. This allows for the use of relatively thin stems, preferably between 1.0 and 3.0 mm in diameter or with a sliced surface of 0.8 and 7.1 $mm^2$, that are at the same time light in weight, durable and stiff, which are important for providing excellent flight qualities. The fiber-reinforced composite is for example a fiber-reinforced resin. The fibers of the stems may comprise carbon nano-tubes. These fibers allow for stems with a high rigidity or stiffness, resulting in further improved flight characteristics. The stems are for example made using pultrusion.

According to a favorable embodiment, the base comprises a conical recess whereby the stems are positioned between the conical surface of the conical recess and an insert, said insert comprising recesses for receiving proximal parts of the plurality of stems.

This is a durable embodiment of the shuttlecock according to the invention. The recesses of the insert may be grooves or holes.

Further preferably, the stems are attached to the insert by means of an overmold, whereby the stems are arranged in the mold to be incorporated in the mold piece during molding. Optionally, the stems and insert are formed in one piece, preferably consisting of one or two component plastic, further preferably by a process of 2K or 3K molding.

The insert is preferably made of plastic. A preferred embodiment of the insert has a protrusion which enables a durable connection of the insert in the base body through a negatively formed recess. Another embodiment of the insert entails a protrusion fixed in the base to which the insert is tightly connected.

According to a favorable embodiment, the sheeting part of the shuttlecock comprises a plurality of cut-outs away from a narrow end thereof; wherein for a plane through the center line of the shuttlecock and halfway between two adjacent stems there is a cut-out between said two stems that is not mirror-symmetric in said plane; and wherein the plurality of cut-outs is capable of providing extra spin of the shuttlecock during flight.

A net contribution of the cut-outs allows the shuttlecock according to the present invention to spin during flight as an alternative to protruding fins, or in combination therewith. The spinning of the shuttlecock smoothens the flight trajectory, increasing stability and providing for drag force.

A preferred total surface area of said plurality of cut-outs at a distance to both the wide end and the narrow end of the sheeting part is preferably 500-1000 mm2 per shuttlecock.

The net contribution of the cut-outs allows the shuttlecock according to the present invention to spin during flight without the necessity of added protruding fins, which would add weight to the pyramidal sheeting part which should be light. The spinning of the shuttlecock smoothens the flight trajectory, increasing stability and providing for the necessary drag force.

Such cut-outs provide a contribution to the drag-coefficient of the shuttle, determining its range. The cut-outs may open up at the narrow edge of the sheeting part, effectively providing a cover of the stems providing some protection if hit directly with a badminton racket.

Thus it is provided according to embodiments of the invention to provide shuttlecocks with a print conveniently, something not possible with injection moulding techniques used in the prior art or for feather shuttlecocks. The print may be a text, logo or color etc. Preferably the print is provided on plastic film of a sheeting part.

According to a favorable embodiment, the method comprises forming the sheeting part by providing the distal part of the plurality of stems with a sleeve of plastic, and subjecting the sleeve of plastic to heat to shrink-wrap said distal part of the plurality of stems.

Thus the sheeting part is formed in a convenient manner. The resulting shuttlecock is better capable of withstanding hits to the sheeting part section.

According to a favorable embodiment, the method comprises providing the distal part of the plurality of stems with a plastic cone having an open wide end and an open narrow end, said plastic cone comprising recesses in the inner wall of the plastic cone for receiving the plurality of stems, at least two of said recesses ending at a distance from the wide end of the plastic cone, and fixing the plastic cone relative to the plurality of stems by receiving the stems in said recesses.

The plastic cone (sleeve) is for example an injection-molded cone or a vacuum-formed cone. Preferably the plastic cone is provided with fins at the wide end or at the outside of the plastic cone to cause the shuttlecock to rotate during flight.

This embodiment allows for a shuttlecock of which the sheeting part can be replaced. If the stems are held in place by the sheeting part, even the stems and/or the base may be replaced.

According to a favorable embodiment, the method comprises:

providing the distal part of the plurality of stems with a plastic cone having an open wide end and an open narrow end, contacting the plastic cone with the stems inserted in the base, and heating and softening the plastic cone in a mold to allow the plastic of the cone to embed the stems over at least 180° of their circumference.

Thus the plastic cone may be permanently attached. Preferably the cone is provided with fins at the wide end to cause the shuttlecock to rotate during flight.

BRIEF DESCRIPTION OF THE DRAWINGS

The present invention will now be illustrated with reference to the drawing wherein.

DESCRIPTION OF THE INVENTION

Figure 1:
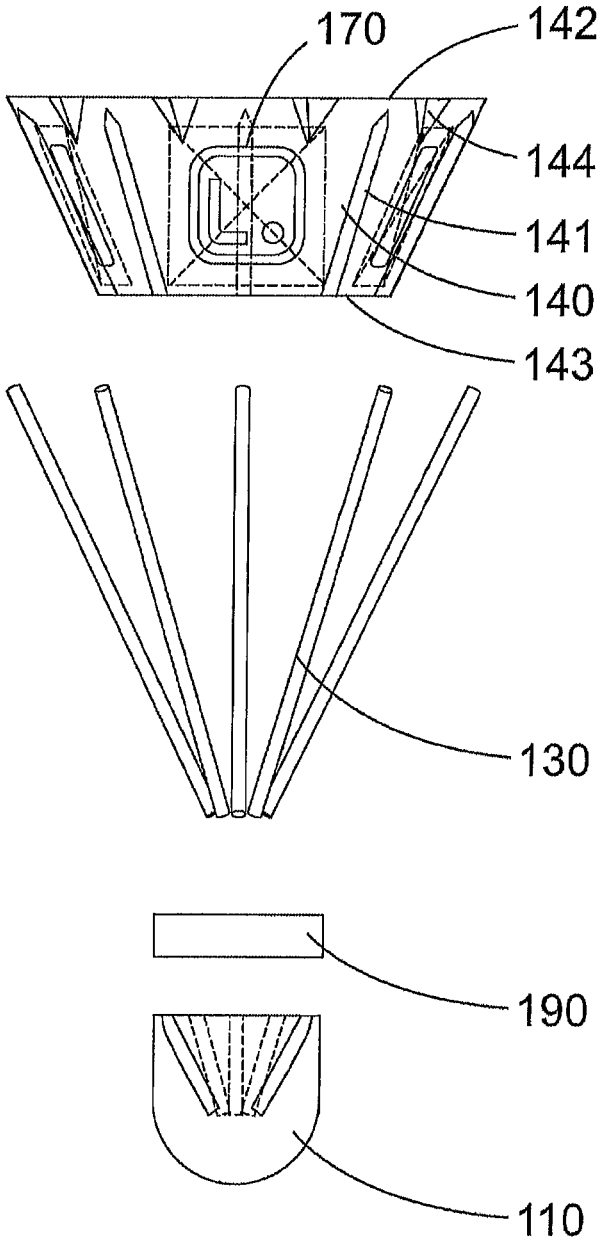
FIG. 1 shows an exploded view of a shuttlecock according to the invention.

FIGS. 1-4 shows an exploded view of a shuttlecock 100 according to the invention, comprising a base 110, a stems part 125, and a pyramidal aerodynamic part 120.

The pyramidal aerodynamic part 120 comprises, at least part of, five stems 130 and a sheeting 140. This number is related to a preferred embodiment providing an advantageous number of stems in proportion to the strength and weight of the stems. Other numbers of stems provide other advantageous proportions.

In the embodiment disclosed here, the stems 130 are fiber stems having a diameter of for example 1.5 mm and a length of 65 mm. A preferred range of such a diameter is between 1.2 and 2.6 mm.

In the embodiment disclosed here, the sheeting 140 is a plastic sheeting 140, made of polypropylene using vacuum forming and comprises an open wide end 142, as arranged at the end of the stems, and an open narrow end 143 as arranged along the stems between the end and the base. At its inside it comprises channels 141 for receiving the stems 130 ending at a distance from the wide end of the plastic sheeting 140. These channels 141 are arranged to receive the stems 130, as is described with reference to FIG. 4A and FIG. 4B.

To obtain rotation during, flight asymmetrical features are provided in the sheeting part 140. Depending on the embodiment, at least one fin or at least one opening at the sheeting material is provided. In the embodiment shown here, the sheeting 140 is provided with fins 144 at the open wide end 142.

Figure 2:
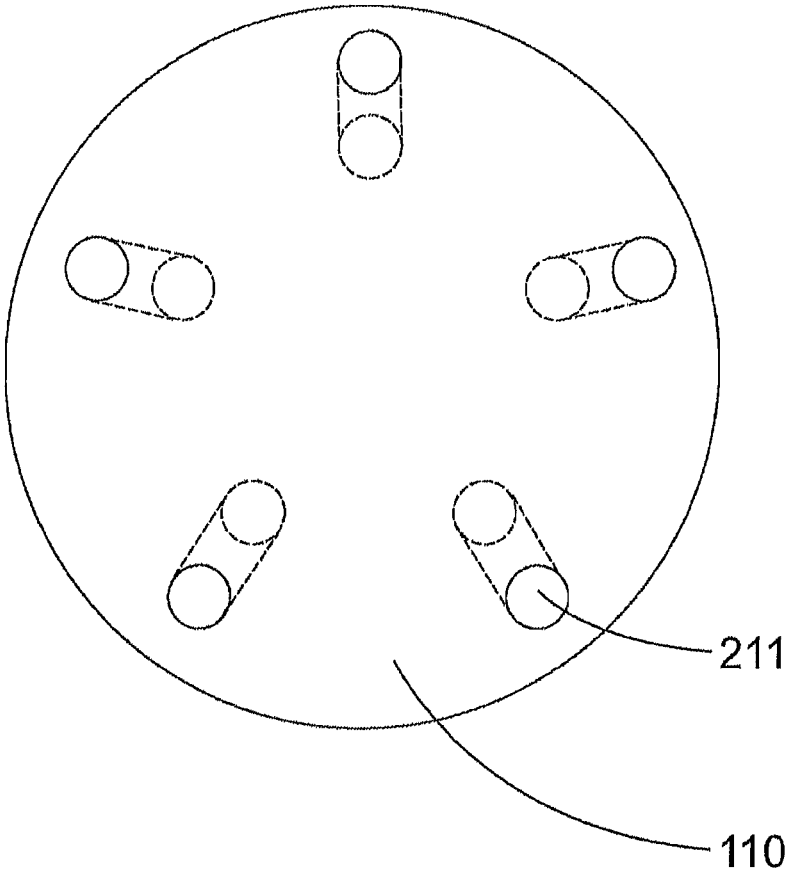
FIG. 2 shows a top view of a shuttlecock base.

In the embodiment shown here the base 110 is provided with a ring 190 not according to the invention FIG. 2 shows a top view of the shuttlecock base 110. It comprises a series of holes 211 drilled into the base material, which is for example polyurethane foam, for receiving the stems 130.

Figure 3:
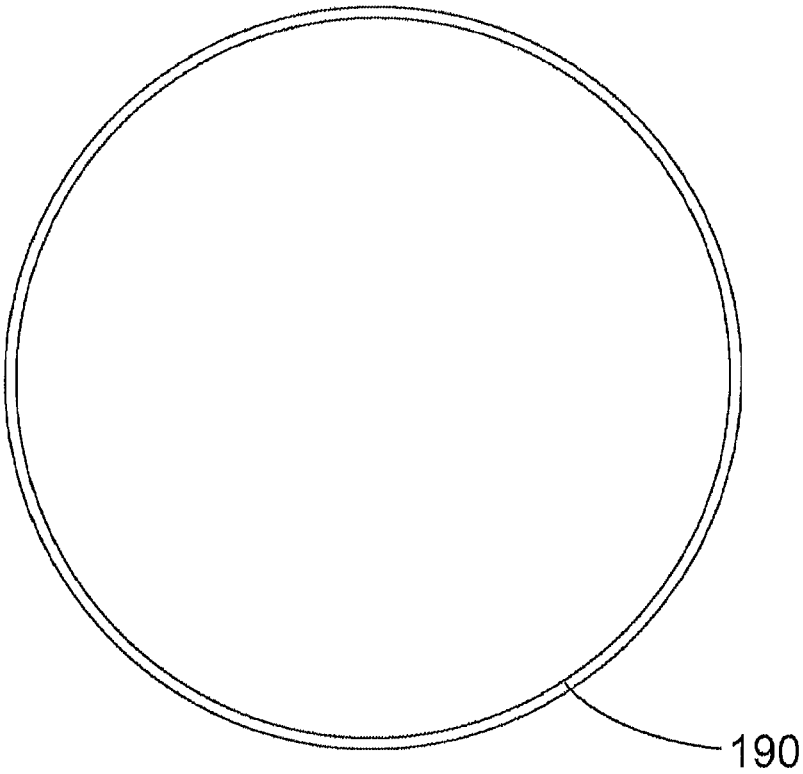
FIG. 3 shows a top view on a ring.

FIG. 3 shows a top view on the optional ring 190, not according to the invention.

Figure 4A:
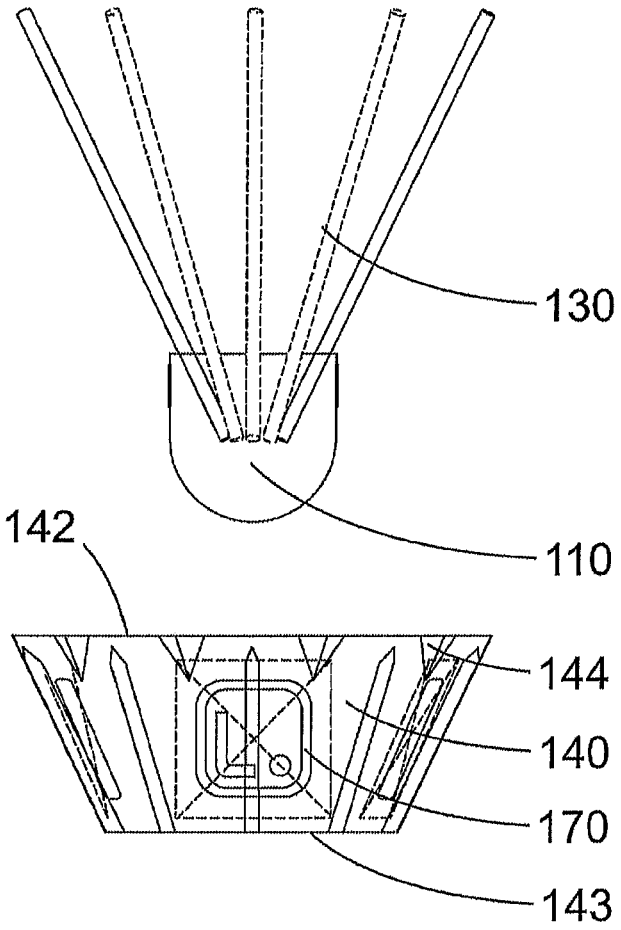
FIG. 4A and FIG. 4B demonstrate a method of manufacturing a shuttlecock according to the invention.
Figure 4B:
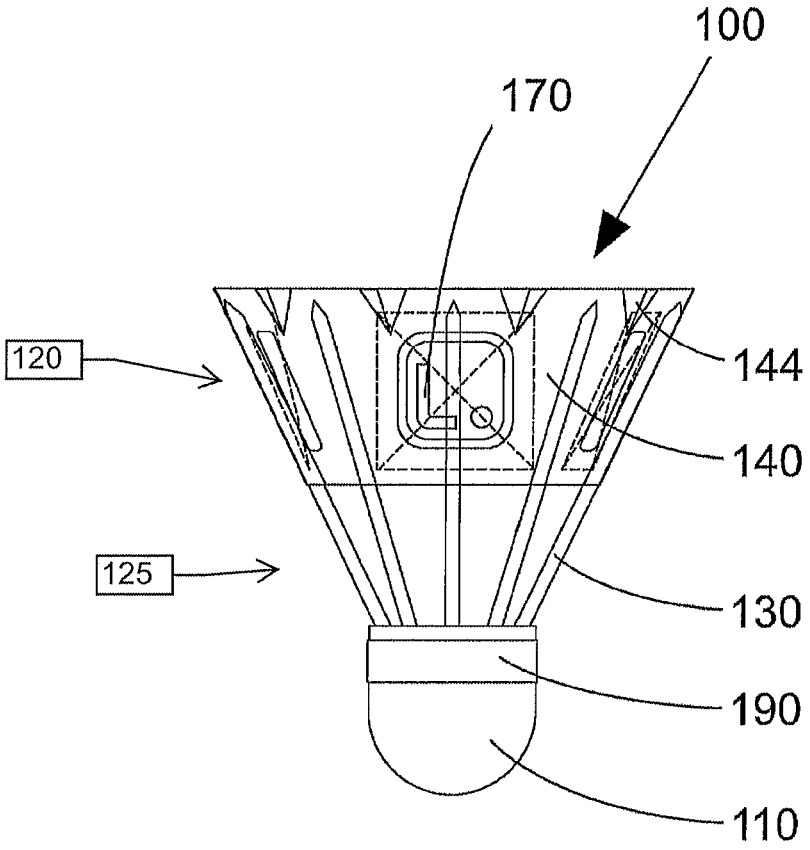

FIG. 4A and FIG. 4B demonstrate a method of manufacturing the shuttlecock 100 of FIG. 1.

Stems 130 are inserted into the holes 211 of the base 110 (FIG. 2; FIG. 4A). The holes 211 or proximal ends of the stems 130 may have been provided with glue.

Then the base 110 provided with the stems 130 is introduced into the open wide end 142 of the sheeting 140. The distal ends of the stems 130 will be pushed somewhat towards the centerline of the base 110 when this insertion is almost completed.

Because the channels 141 end at a distance from the open wide end 142, movement of the sheeting 140 in the opposite direction is now prevented and the sheeting 140 is attached without further tools, glue or operation, resulting in the finished shuttlecock 100 (FIG. 4B).

In an alternative method of manufacturing, a shuttlecock according to the invention is the base 110 provided with stems 130 is introduced into a cylindrical sleeve of shrink-wrap plastic, which is subsequently subjected to heat, as a result of which the plastic is tightly wrapped around the distal ends of the stems.

Figure 5:
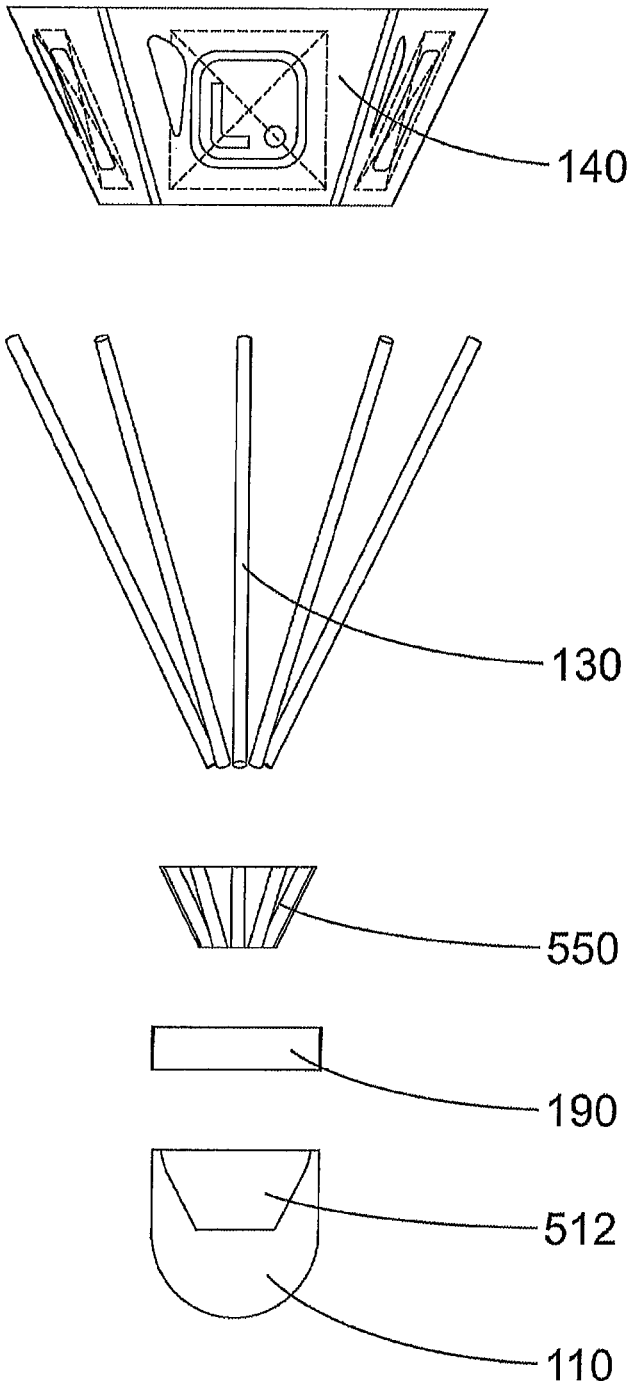
FIG. 5 shows an exploded view of an alternative shuttlecock according to the invention.

FIG. 5 shows an exploded view of an alternative shuttlecock 100 according to the invention that substantially corresponds to the shuttlecock of FIG. 4B, except that use is made of an insert 550 to facilitate manufacturing and to increase the stability of the stems in the base.

The base 110 comprises a recess 512, the function of which will be explained with reference to FIG. 7.

Figure 6:
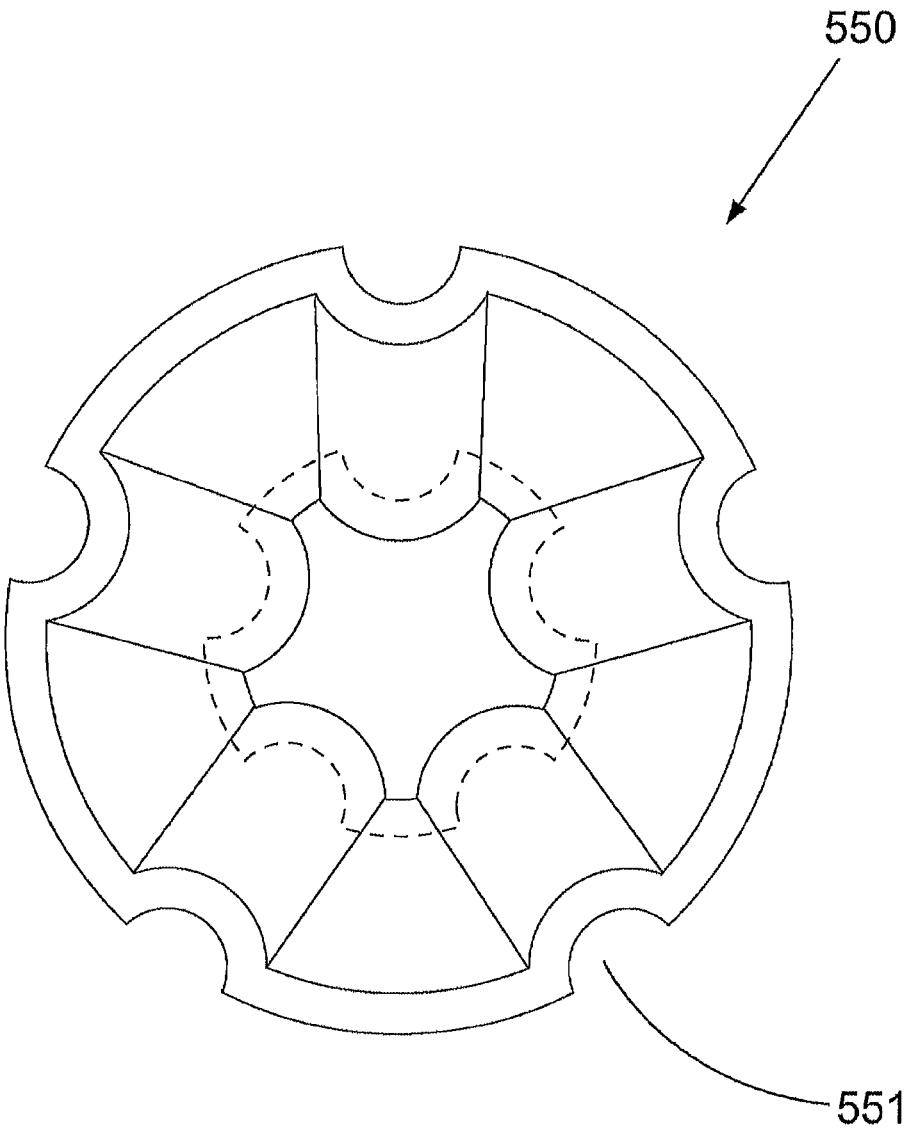
FIG. 6 shows a topview of an insert of the shuttlecock of FIG. 5.

The insert 550 is shown in top view in FIG. 6. Instead of individual holes 211 that require more work or a more expensive mold, the insert 550 comprises recesses 551 for receiving the stems 130.

Figure 7:
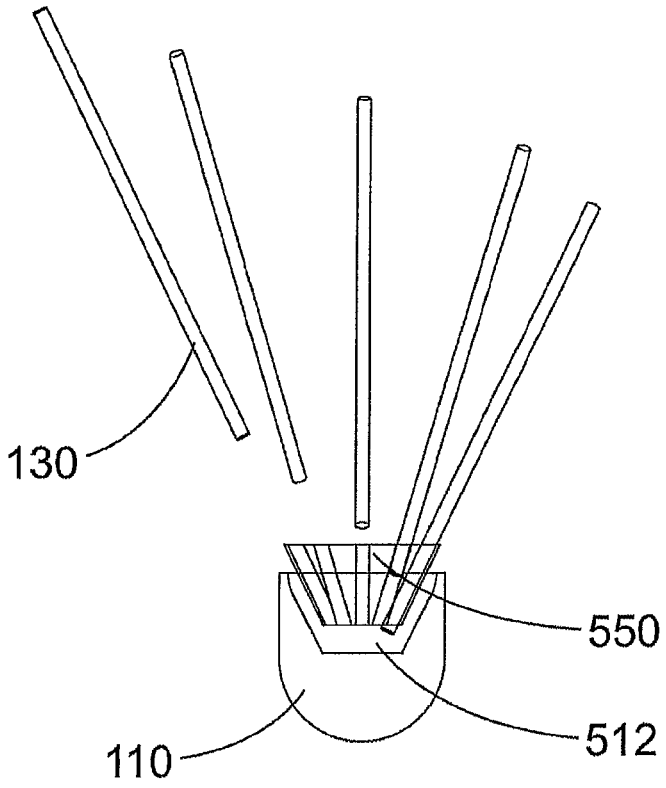
FIG. 7 corresponds with FIG. 4A to demonstrate a method of manufacturing the shuttlecock of FIG. 5.

FIG. 7 shows the use of the insert 550 to distribute the stems 130 in the recess 512, which has a frustopyramidal shape. The insert 550 and the stems 130 may be glued to the base 110 or over molded to basically form an integrated part. An alternative manner of operation is that first the insert 550 is provided with the stems 130. To this end, the insert 550, which is typically made of plastic, may be designed to receive and hold the stems 130 by clicking them in the recesses 551 of the insert 550, or they may be glued to the insert 550. Subsequently, the unit formed of stems 130 and insert 550 is introduced in the recess 512 of the base 110. The insert 550 may have a protrusion to fix (click) the insert 550 durably in the base 110.

According to the invention the stems are made of a fiber reinforced composite e.g. a glass fiber or carbon fiber reinforced resin. The thickness will depend on the number of stems, with a higher number, the thickness may be less.

Figure 8:
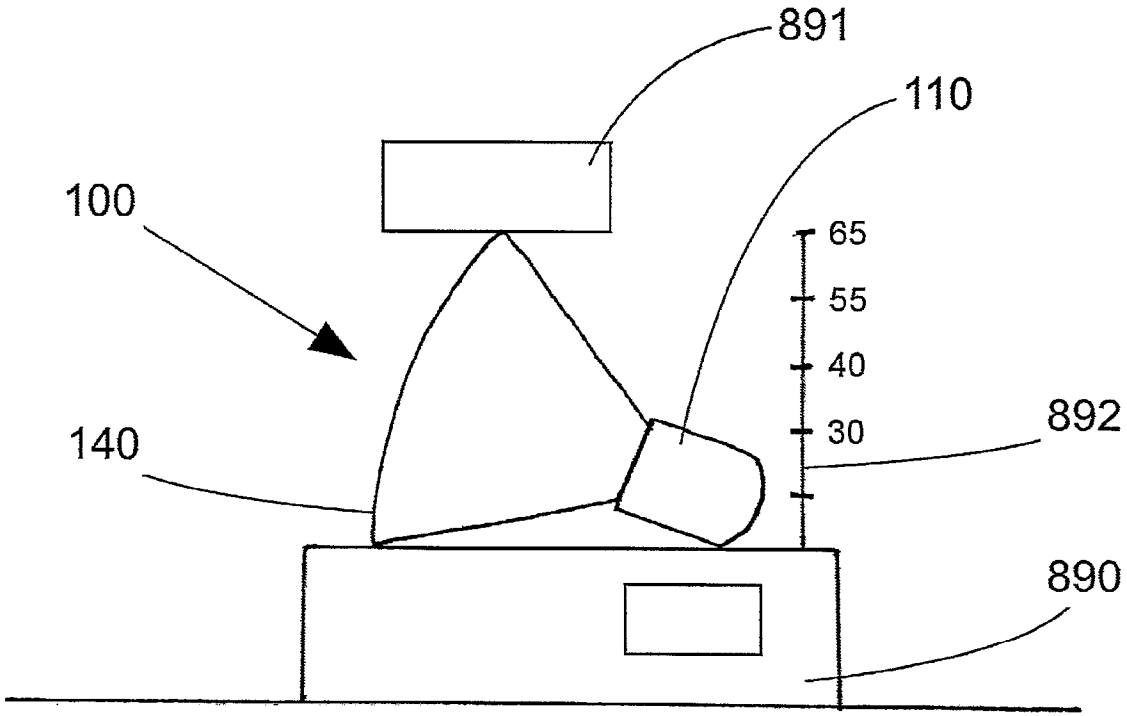
FIG. 8 demonstrates a method for determining the stiffness of a shuttlecock.

FIG. 8 demonstrates a method of determining a suitable stiffness of the pyramidal aerodynamic part 120. A shuttlecock is placed onto an electronic scale 890 with the base 110 and the sheeting 140 resting on the top surface of the scale 890. A flat object 891 is moved horizontally towards the shuttlecock to squeeze the shuttlecock between the flat object 891 and the electronic scale 890. For a reduction by 10 mm of the distance (determined using a ruler 892) between i) the point of first contact of the flat object and the sheeting part, and ii) the scale, the weight increase as determined using the scale 890 is preferred to be at least 150 g, further preferably be at least 200 g, further preferably be at least 300 g and further preferably at least 400 g. This is valid irrespective of which part of the outer circumference of the sheeting part of the shuttlecock rests on the scale (i.e. irrespective of how the shuttlecock is rotated about its central axis). These values exceed the specifications of plastic shuttlecocks and even of feather shuttlecocks.

Figure 9:
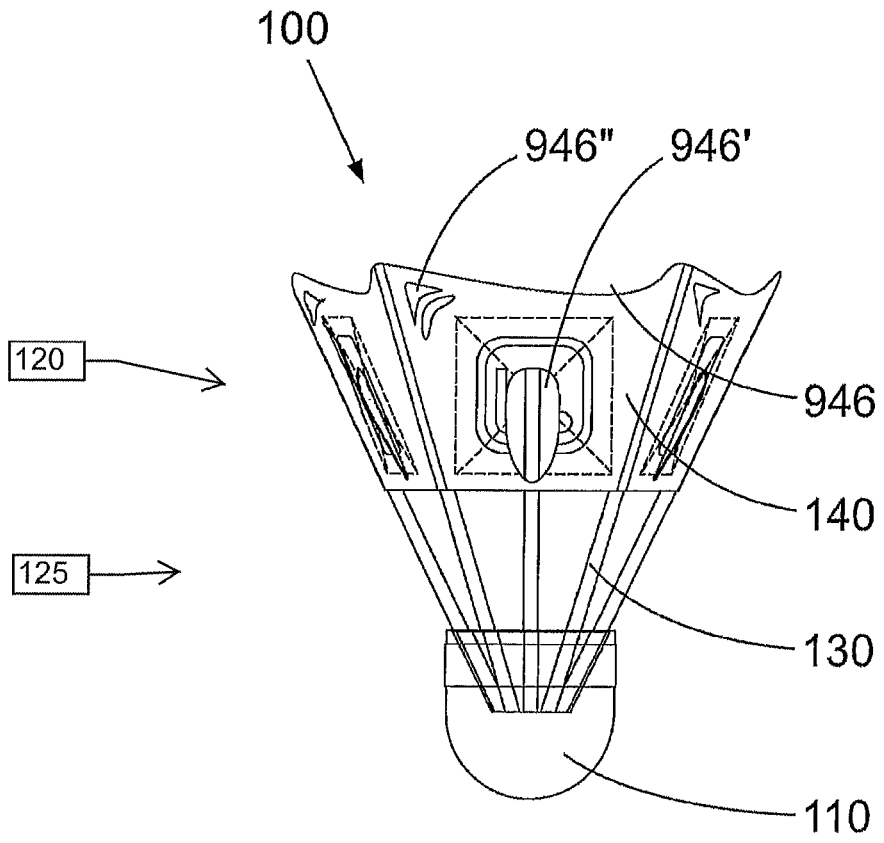
FIG. 9 shows a sideview of an alternative embodiment of a shuttlecock according to the invention.

FIG. 9 shows an alternative embodiment of a shuttlecock 100 according to the invention. The sheeting 140 of the shuttlecock 100 comprises at its wide end asymmetrical cut-outs 946. These asymmetrical cut outs are preferably arranged in a plane of the sheeting part away from the center line and preferably halfway the centerline and the closest stem 130. Such eccentric openings provide for an effect bringing the shuttlecock into rotation around its heart-line through the center of the base.

In the embodiment shown in FIG. 9, the sheeting 140 is provided with slits 946' and holes 946" in the sheeting 140. The holes 946" provide the shuttlecock 100 with spin in flight. The slits 946' affect the drag coefficient and thus the length of the flight.

Figure 10A:
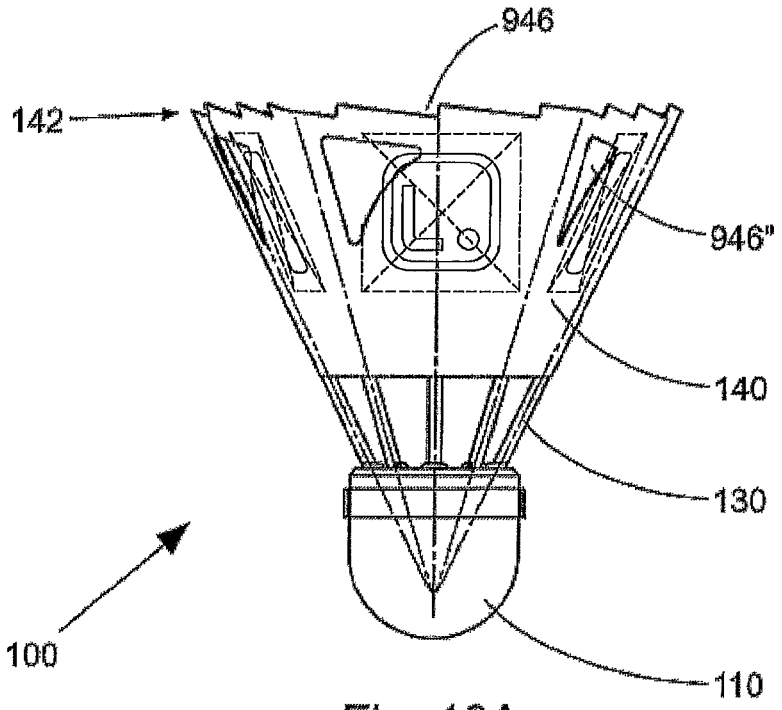
FIG. 10A and FIG. 10B show a side view and a rear view of an embodiment of the shuttlecock according to the invention.
Figure 10B:
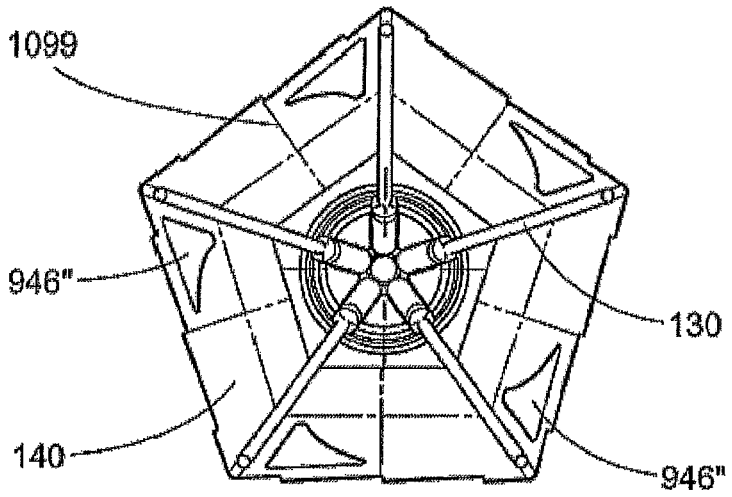

FIG. 10A and FIG. 10B show a side view and a rear view respectively of a preferred embodiment of the shuttlecock 100 according to the invention. It has five stems 130, and two types of cut-outs, i.e. cut-outs 946 at the edge of the wide end of the sheeting 140 and holes 946" to provide spin during flight.

Lines 1099 are indicative of the planes through the centerline of the shuttlecock 100 and show that the positions of the holes 946" are not mirror-symmetric in said planes.

Figure 11:
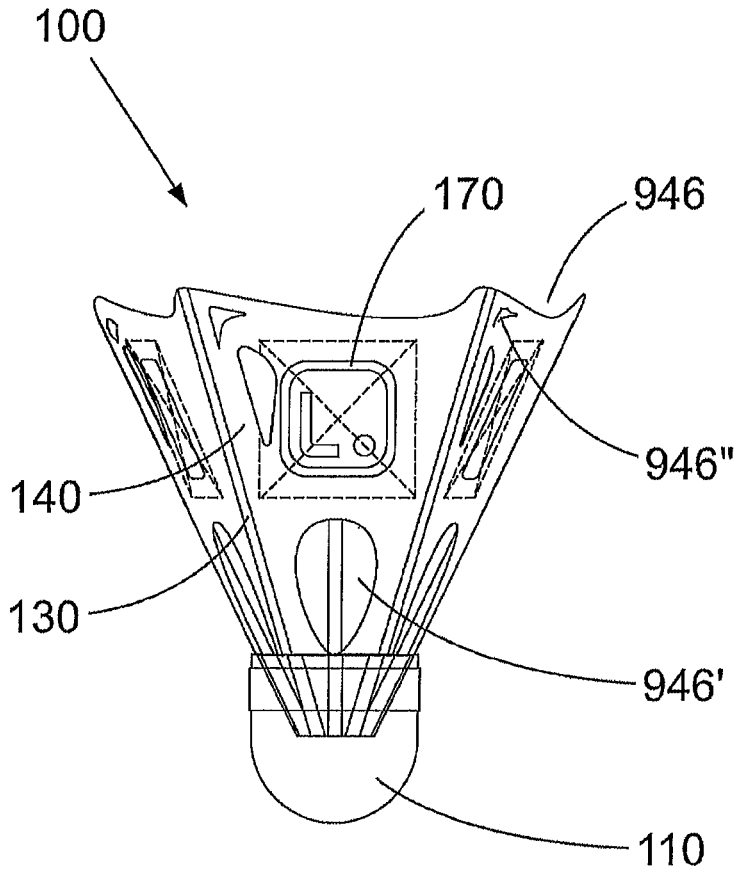
FIG. 11 shows an alternative embodiment of the shuttlecock of FIG. 10A.

FIG. 11 shows an alternative embodiment of the shuttlecock 100 of FIG. 10A, wherein the sheeting 140 extends to the base 110, with slits 946' leaving the stems 125 covered by the sheeting 140 so as to provide some protection of the stems against a direct hit.

A method according to any of the above, wherein the method comprises steps of:

providing the distal part of the plurality of stems (130) with a plastic cone having an open wide end (142) and an open narrow end (143), said plastic cone comprising channels (141) in the inner wall of the plastic cone for receiving the plurality of stems (130), at least two of said channels (141) ending at a distance from the wide end (142) of the plastic cone, and fixing the plastic cone relative to the plurality of stems (130) by receiving the stems (130) in said channels (141).

A method according to any of the above, wherein the method comprises:

providing the distal part of the plurality of stems (130) with a plastic cone having an open wide end (142) and an open narrow end (143), contacting the plastic cone with the stems (130) inserted in the base (110), and heating and softening the plastic cone in a mold to allow the plastic of the cone to embed the stems (130) over at least 180° of their circumference.

The invention can be varied within the scope of the appended claims. With respect to the independent method claim, it is envisaged to provide the sleeve with a print or with a further print after the shuttlecock has been assembled. This provides the print or printing between two adjacent stems. The planar or substantially planar shape of the sleeve resulting from the sleeve according to the invention extending between adjacent stems enables relatively easy printing.

As such, the present invention is described in the foregoing on the basis of several preferred embodiments. Different aspects of different embodiments can be combined, wherein all combinations which can be made by a skilled person on the basis of this document must be included. These preferred embodiments are not limitative for the scope of protection of this document. The rights sought are defined in the appended claims.

The invention claimed is:

1. A shuttlecock comprising a striking part and an aerodynamic part, the shuttlecock comprising:

a base to serve as striking element for the striking part shuttlecock;

a stems part formed by a plurality of stems to provide support to the aerodynamic part, the stems being connected or connectable with the base;

a sheeting part formed by a sheeting for forming of an aerodynamic member of the aerodynamic part attached or attachable to the stems; and an aerodynamic spin inducing means for providing a substantially axial rotation or spin to the shuttlecock during flight, wherein the stems part substantially has a shape of a pyramidal stems frustum, the base of the frustum conforming to an open end of the aerodynamic part, wherein the sheeting part, while attached to the stems, substantially has a shape of a pyramidal sheeting frustum, wherein edges of the pyramidal sheeting frustum are defined by respective edges of the pyramidal stems frustum at an overlapping part of the sheeting part with the stems part, such that the aerodynamic part substantially has the shape of a pyramidal frustum defined by the pyramidal stems frustum and the pyramidal sheeting frustum, wherein the stems have a determined stiffness to define the pyramidal frustum shape of the aerodynamic part, and wherein the stems are fixated relative to the base such that the stems part substantially has a shape in the form of the pyramidal frustum.

2. The shuttlecock according to claim 1, wherein the stems each form a self-supporting edge part of the pyramidal stems frustum.

3. The shuttlecock according to claim 1, wherein the stems have a bigger thickness near the base than a distal end of the stems directed away from the base.

4. The shuttlecock according to claim 1, wherein the pyramidal frustum is a polygonal pyramidal frustum with clearly distinguishable planes between the edges, the planes being suitable for comprising a graphical representation.

5. The shuttlecock according to claim 4 further comprising a print on one or more of the planes of the pyramidal shape.

6. The shuttlecock according to claim 1, wherein the pyramidal frustum is based on a polygon of less than 10 sides, being a triangular pyramid, a quadrangular pyramid, a pentagonal pyramid, a hexagonal pyramid, a septagonal pyramid or octagonal pyramid, or a pentagonal pyramid, and wherein the sides provide clearly distinguishable planes between the edges.

7. The shuttlecock according to claim 1, wherein the pyramidal sheeting frustum having imperfect character such as forming an imperfect pyramidal sheeting frustum or a loosely pyramidal sheeting frustum.

8. The shuttlecock according to claim 1, wherein the sheeting is formed from a textile or a plastic.

9. The shuttlecock according to claim 8, wherein the plastic is a plastic film.

10. The shuttlecock according to claim 9, wherein the plastic film is a plastic film reinforced with fibers, the material preferably being printable.

11. The shuttlecock according to claim 8, wherein the plastic comprises nylon or polypropylene.

12. The shuttlecock according to claim 1, wherein the sheeting part extends to at least a distal end of the stems.

13. The shuttlecock according to claim 1, wherein the sheeting part is provided with one or more layers.

14. The shuttlecock according to claim 1, wherein the stems comprise a fiber-reinforced composite and/or the stems comprise a polyether ether ketone material.

15. The shuttlecock according to claim 14, wherein the fiber is carbon-fiber or glass-fiber.

16. The shuttlecock according to claim 1, wherein the base comprises a substantially conical recess whereby the stems positioned between a conical surface of the conical recess and an insert, the insert comprising recesses for receiving end parts of the plurality of stems.

17. The shuttlecock according to claim 1, wherein the spin inducing means are embodied by at least one opening in the sheeting part, preferably by one opening in the sheeting part per plane of the pyramidal sheeting frustum.

18. The shuttlecock according to claim 1, wherein the spin inducing means are embodied by at least one opening in the sheeting part per plane of the pyramidal sheeting frustum.

19. The shuttlecock according to claim 1, wherein the spin inducing means comprises at the edge of a wide end thereof a plurality of cut-outs.

20. The shuttlecock according to claim 1, wherein the sheeting part is adhered to the stems by glue, friction fit, or melting.

21. A method of assembling a shuttlecock comprising:

providing a shuttlecock, the shuttlecock including:

a base to serve as striking element for the striking part of shuttlecock;

a stems part formed by a plurality of stems to provide support to an aerodynamic part, the stems being connected or connectable with the base; and a sheeting part formed by a sheeting for forming of an aerodynamic member of the aerodynamic part attached or attachable to the stems;

arranging and/or fixating the stems part relative to the base such that the stems part substantially has a shape in the form of a pyramidal stems frustum, the base of the frustum preferably being formed by an open end of the aerodynamic part; and arranging and/or fixating the sheeting part at the stems part such that the sheeting part obtain substantially a shape in the form of a pyramidal sheeting frustum, wherein the edges of the pyramidal sheeting frustum are defined by respective edges of the pyramidal stems frustum at an overlapping part of the sheeting part with the stems part, such that the aerodynamic part substantially has the shape of a pyramidal frustum, defined by the pyramidal stems frustum and the pyramidal sheeting frustum, and wherein the stems having a determined stiffness to define the pyramidal frustum shape of the aerodynamic part and provide the shape of the sheeting part to the sheeting part, and wherein the stems comprise a fiber-reinforced composite.

22. The method according to claim 21, comprising steps of adhering the sheeting part to the stems by gluing, friction fitting, or melting.

23. The method according to claim 21 further comprising providing the sheeting part with a print, preferably a print per plane of the pyramidal frustum.

24. The method according to claim 21, wherein fiber of the stems comprises at least one of carbon-fiber and glass-fiber.

25. The method according to claim 21 further comprising providing the base with a plurality of holes and inserting stems into the holes of the base.

26. The method according to claim 21 further comprising providing a base comprising a conical recess with the stems, the stems being positioned between a conical surface of the recess and an insert, the insert including recesses for receiving proximal parts of the plurality of stems.

27. The method according to claim 21, wherein five stems are provided with the sheeting part comprising a plastic film reinforced with fibers.

28. The method according to claim 21, wherein forming the sheeting part includes providing an end part of the plurality of stems with a sleeve of plastic, and subjecting the sleeve of plastic to heat to shrink-wrap the end part of the plurality of stems.

* * * * *